US006504308B1

(12) United States Patent
Krichtafovitch et al.

(10) Patent No.: US 6,504,308 B1
(45) Date of Patent: Jan. 7, 2003

(54) ELECTROSTATIC FLUID ACCELERATOR

(75) Inventors: Igor A. Krichtafovitch, Bothell, WA (US); Robert L. Fuhriman, Jr., Bellevue, WA (US)

(73) Assignee: Kronos Air Technologies, Inc., Bellevue, WA (US)

( * ) Notice: Subject to any disclaimer, the term of this patent is extended or adjusted under 35 U.S.C. 154(b) by 0 days.

(21) Appl. No.: 09/419,720

(22) Filed: Oct. 14, 1999

Related U.S. Application Data

(63) Continuation of application No. 60/104,573, filed on Oct. 16, 1998.

(51) Int. Cl.[7] ..... H01J 7/24

(52) U.S. Cl. ..... 315/111.91; 315/111.21; 250/423 R

(58) Field of Search ..... 315/111.91, 111.61, 315/111.81, 111.01, 111.21, 111.31, 39, 506, 500; 250/423 R, 426; 313/360.1

(56) References Cited

U.S. PATENT DOCUMENTS

| | | | | |
|---|---|---|---|---|
| 1,888,606 A | | 11/1932 | Nesbit | |
| 2,949,550 A | | 8/1960 | Brown | |
| 3,108,394 A | | 10/1963 | Ellman et al. | |
| 3,267,860 A | | 8/1966 | Brown | |
| 3,374,941 A | | 3/1968 | Okress | |
| 3,518,462 A | | 6/1970 | Brown | |
| 3,582,694 A | * | 6/1971 | Gourdine | 310/10 |
| 3,638,058 A | | 1/1972 | Fritzius | |
| 3,675,096 A | | 7/1972 | Kiess | |
| 3,699,387 A | | 10/1972 | Edwards | |
| 3,751,715 A | | 8/1973 | Edwards | |
| 3,896,347 A | | 7/1975 | Gelfand | |
| 3,936,635 A | | 2/1976 | Clark | |
| 3,983,393 A | | 9/1976 | Thettu et al. | |
| 4,008,057 A | | 2/1977 | Gelfand et al. | |
| 4,011,719 A | | 3/1977 | Banks | |
| 4,061,961 A | | 12/1977 | Baker | |
| 4,086,650 A | | 4/1978 | Davis et al. | |
| 4,124,003 A | | 11/1978 | Abe et al. | |
| 4,162,144 A | | 7/1979 | Cheney | |

(List continued on next page.)

*Primary Examiner*—Don Wong
*Assistant Examiner*—Ephrem Alemu
(74) *Attorney, Agent, or Firm*—Fulbright & Jaworski, LLP

(57) ABSTRACT

An electrostatic fluid accelerator having a multiplicity of closely spaced corona electrodes. The close spacing of such corona electrodes is obtainable because such corona electrodes are isolated from one another with exciting electrodes. Either the exciting electrode must be placed asymmetrically between adjacent corona electrodes or an accelerating electrode must be employed. The accelerating electrode can be either an attracting or a repelling electrode. Preferably, the voltage between the corona electrodes and the exciting electrodes is maintained between the corona onset voltage and the breakdown voltage with a flexible top high-voltage power supply. Optionally, however, the voltage between the corona electrodes and the exciting electrodes can be varied, even outside the range between the corona onset voltage and the breakdown voltage, in to vary the flow of fluid. And, to achieve the greatest flow of fluid, multiple stages of the individual Electrostatic Fluid Accelerator are utilized with a collecting electrode between successive stages in order to preclude substantially all ions and other electrically charged particles from passing to the next stage, where they would tend to be repelled and thereby impair the movement of the fluid. Finally, constructing the exciting electrode in the form of a plate that extends downstream with respect to the desired direction of fluid flow also assures that more ions and, consequently, more fluid particles flow downstream.

29 Claims, 8 Drawing Sheets

U.S. PATENT DOCUMENTS 4,231,766 A 11/1980 Spurgin
4,240,809 A 12/1980 Eisbernd et al.
4,246,010 A 1/1981 Honacker
4,266,948 A 5/1981 Teague et al.
4,267,502 A 5/1981 Reese et al.
4,292,493 A 9/1981 Sejander et al.
4,313,741 A 2/1982 Masuda et al.
4,335,414 A 6/1982 Weber
4,351,648 A 9/1982 Penney
4,379,129 A 4/1983 Abe
4,388,274 A 6/1983 Rourke et al.
4,390,831 A 6/1983 Byrd et al.
4,567,541 A * 1/1986 Terai ..... 361/235
4,600,411 A * 7/1986 Santamaria ..... 96/82
4,643,745 A 2/1987 Sakakibara et al.
4,673,416 A 6/1987 Sakakibara et al.
4,689,056 A 8/1987 Noguchi et al.
4,719,535 A 1/1988 Zhenjun et al.
4,789,801 A 12/1988 Lee
4,812,711 A 3/1989 Torok et al.
4,837,658 A 6/1989 Reale
4,853,719 A 8/1989 Reale
4,853,735 A 8/1989 Kodama et al.
4,924,937 A 5/1990 Beal et al.
4,941,353 A 7/1990 Fukatsu et al.
4,980,611 A 12/1990 Orenstein
4,996,473 A 2/1991 Markson et al.
5,012,159 A 4/1991 Torok et al.
5,024,685 A 6/1991 Torok et al.
5,055,118 A * 10/1991 Nagoshi et al. ..... 96/88
5,077,500 A * 12/1991 Torok et al. ..... 315/111.91
5,155,531 A 10/1992 Kurotori et al.
5,245,692 A 9/1993 Kawai
5,330,559 A 7/1994 Cheney et al.
5,469,242 A 11/1995 Yu et al.
5,474,599 A 12/1995 Cheney et al.
5,556,448 A 9/1996 Cheney et al.
5,578,112 A 11/1996 Krause
5,661,299 A * 8/1997 Purser ..... 250/281
5,667,564 A 9/1997 Weinberg
5,707,428 A * 1/1998 Feldman et al. ..... 96/54
5,769,155 A 6/1998 Ohadi et al.
5,814,135 A 9/1998 Weinberg
5,827,407 A 10/1998 Wang et al.
5,892,363 A 4/1999 Roman
5,899,666 A 5/1999 Chung et al.
5,951,957 A 9/1999 Simpson
5,973,905 A 10/1999 Shaw
5,982,102 A 11/1999 Andzej
5,993,521 A 11/1999 Loreth et al.
6,042,637 A 3/2000 Weinberg
6,056,808 A 5/2000 Krause
6,084,350 A 7/2000 Ezaki et al.
6,145,298 A 11/2000 Burton
6,152,146 A 11/2000 Taylor et al.
6,167,196 A 12/2000 Huggins et al.
6,176,977 B1 1/2001 Taylor et al.
6,182,671 B1 2/2001 Taylor et al.
6,200,539 B1 3/2001 Sherman et al.
6,203,600 B1 3/2001 Loreth
6,210,642 B1 4/2001 Lee et al.
6,245,126 B1 6/2001 Feldman et al.
6,245,132 B1 6/2001 Feldman et al.
6,313,064 B1 11/2001 Miyafuji et al.

* cited by examiner-

ELECTROSTATIC FLUID ACCELERATOR

CROSS-REFERENCE TO RELATED APPLICATION

This is a continuation of a copending U.S. provisional application Ser. No. 60/104,573, filed on Oct. 16, 1998.

BACKGROUND OF THE INVENTION

1. Field of the Invention

This invention relates to a device for accelerating, and thereby imparting velocity and momentum to a fluid, especially to air, through the use of ions and electrical fields.

2. Description of the Related Art

A number of patents (see, e.g., U.S. Pat. Nos. 4,210,847 and 4,231,766) have recognized the fact that ions may be generated by an electrode (termed the "corona electrode"), attracted (and, therefore, accelerated) toward another electrode (termed the "attracting electrode"), and impart momentum, directed toward the attracting electrode, to surrounding air molecules through collisions with such molecules.

The corona electrode must either have a sharp edge or be small in size, such as a thin wire, in order to create a corona discharge and thereby produce in the surrounding air ions of the air molecules. Such ions have the same electrical polarity as does the corona electrode.

Any other configuration of corona electrodes and other electrodes where the potential differences between the electrodes are such that ion-generating corona discharge occurs at the corona electrodes may be used for ion generation and consequent fluid acceleration.

When the ions collide with other air molecules, not only do such ions impart momentum to such air molecules, but the ions also transfer some of their excess electric charge to these other air molecules, thereby creating additional molecules that are attracted toward the attracting electrode. These combined effects cause the so-called electric wind.

However, because a small number of ions are generated by the corona electrode in comparison to the number of air molecules which are in the vicinity of the corona electrode, the ions in the present electric wind generators must be given initial high velocities in order to move the surrounding air. To date, even these high initial ionic velocities have not produced significant speeds of air movement. And, even worse, such high ionic velocities cause such excitation of surrounding air molecules that substantial quantities of ozone and nitrogen oxides, all of which have. well-known detrimental environmental effects, are produced.

Presently, no invention has even attained significant speeds of air movement, let alone doing so without generating undesirable quantities of ozone and nitrogen oxides.

Three patents, viz., U.S. Pat. Nos. 3,638,058; 4,380,720; and 5,077,500, have, however, employed on a rudimentary level some of the techniques which have enabled the present inventors to achieve significant speeds of air movement and to do so without generating undesirable quantities of ozone and nitrogen oxides.

U.S. Pat. No. 5,077,500, in order to ensure that all corona electrodes "work under mutually the same conditions and will thus all engender mutually the same corona discharge," uses other electrodes to shield the corona electrodes from the walls of the duct (in which the device of that patent is to be installed) and from other corona electrodes. These other electrodes, according to lines 59 through 60 in column 3 of the patent, ". . . will not take up any corona current . . . "

Also, U.S. Pat. No. 4,380,720 employs multiple stages, each consisting of pairs of a corona electrode and an attracting electrode, so that the air molecules which have been accelerated to a given speed by one stage will be further accelerated to an even greater speed by the subsequent stage. U.S. Pat. No. 4,380,720 does not, however, recognize the need to neutralize substantially all ions and other electrically charged particles, such as dust, prior to their approaching the corona electrode of the subsequent stage in order to avoid having such ions and particles repelled by that corona electrode in an upstream direction, i.e., the direction opposite to the velocity produced by the attracting electrode of the previous stage.

And U.S. Pat. No. 5,077,500, on lines 25 through 29 of column 1, states, "The air ions migrate rapidly from the corona electrode to the target electrode, under the influence of the electric field, and relinquish their electric charge to the target electrode and return to electrically neutral air molecules." The fact that the target electrode is not, however, so effective as to neutralize substantially all of the air ions is apparent from the discussion of ion current between the corona electrode K and the surfaces 4, which discussion is located on lines 15 through 27 in column 4.

Similarly, U.S. Pat. No. 3,638,058 provides, on line 66 of column 1 through line 13 of column 2, ". . . it can be seen that with a high DC voltage impressed between cathode point 12 and ring anode 18, an electrostatic field will result causing a corona discharge region surrounding point 14. This corona discharge region will ionize the air molecules in proximity to point 14 which, being charged particles of the same polarity as the cathode, will, in turn, be attracted toward ring anode 18 which will also act as a focusing anode. The accelerated ions will impart kinetic energy to neutral air molecules by repeated collisions and attachment. Neutral air molecules thus accelerated, constitute the useful mechanical output of the ion wind generator. The majority of ions, however, will end their usefulness upon reaching the ring 18 where they fan out radially and collide with the ring producing anode current. A small portion of the ions will possess sufficient kinetic energy to continue on through the ring along with the neutral particles. These result in a slight loss of efficiency because they tend to be drawn back to the anode. The same theory will apply for cathode 13 and anode 17. Since opposite polarities are impressed on each cathode-anode pair, their exiting airstreams will contain oppositely charged ions which will merge and neutralize; i.e., being of opposite polarity, the ions will attract each other and be neutralized by recombination." It is, however, not clear that substantially all ions which escape the electrodes will merge because many ions emerging from the anode on the left are likely to have such momentum toward the left that the electrical attraction for ions emerging from the anode on the right with momentum toward the right is insufficent to overcome such opposite momenta. Furthermore, the distance required for such recombination as does occur is very probably so great that it would be a detriment to using multiple stages to provide increased speed to the air.

SUMMARY OF THE INVENTION

The present Electrostatic Fluid Accelerator employs two fundamental techniques to achieve significant speeds in the fluid flow, which can be virtually any fluid but is most often air, and which will not produce substantial undesired ozone and nitrogen oxides when the fluid is air.

First, to accelerate the fluid molecules significantly without having to impart high velocities to the ions, many ions are created within a given area so that there is a high density, or pressure, of ions. This is achieved by placing a multiplicity of corona electrodes close to one another. The corona electrodes can be placed near one another because they are electrically shielded from one another by exciting electrodes which have a potential difference, compared to the corona electrodes, adequate to generate a corona discharge. An exciting electrode is placed between adjacent corona electrodes and, thus, across the intended direction of flow for the fluid molecules.

In order to cause ions to create fluid flow, either the exciting electrode must be asymmetrically located between the adjacent corona electrodes (in order to create an asymmetrically shaped electric field that, unlike a symmetrical field, will force ions in a preferred direction) or there must be an accelerating electrode.

Preferably, in the case of an accelerating electrode, such accelerating electrode is an attracting electrode placed downstream from the corona electrodes in order to cause the ions to move in the intended direction. The electric polarity of the attracting electrode is opposite to that of the corona electrode.

It has, however, been experimentally determined that, when the corona electrodes are close to one another, if the electric potential of the exciting electrode is between that of the of the corona electrode and that of the attracting electrode, as in the case with respect to U.S. Pat. No. 5,077,500, the rate of fluid flow decreases. Indeed, when the electric potential of the exciting electrodes is the same as that of the corona electrode, no fluid flow occurs. This effect results from the fact that the electric field strength between the exciting electrode and the corona electrodes is not adequate to cause a corona discharge and produce ions; the corona discharge between the corona electrode and the attracting electrode is suppressed; and the consequent lower density of ions is inadequate to produce the desired flow of fluid, or, as explained above, any flow at all when the electric potential of the exciting electrodes is the same as that of the corona electrode. Furthermore, when the corona electrodes are placed close together in order to increase the density of ions, as described above, the electric field between the corona electrodes and the exciting electrodes influences the electric field between the corona electrodes and the attracting electrode. Thus, to achieve desirable flow rates, it is preferable to maintain the electric field strength between the exciting electrodes and the corona electrodes at a level that will produce a corona discharge and, consequently, a current flow from the corona electrodes to the exciting electrodes.

Yet, since the rate of fluid flow can be controlled by varying the electric field strength between the exciting electrode and the corona electrodes and since such electric field strength can be adjusted by varying the electric potential of the exciting electrode, the electric potential of the exciting electrodes can be varied in order to control the flow rate of the fluid with less expenditure of energy than when this is accomplished by controlling the potential of the attracting electrode.

Optionally, as suggested above, rather than using an attracting electrode as the accelerating electrode, a repelling electrode can be placed upstream from the corona electrode. The electrical polarity of the repelling electrode is the same as that of the corona electrode. From a repelling electrode, however, there is no corona discharge.

Second, in order to achieve the greatest flow of fluid, multiple stages of corona discharge devices are used with a collecting electrode between each stage. The collecting electrode has opposite electrical polarity to that of the corona electrodes. The collecting electrode is designed to preclude substantially all ions and other electrically charged particles from passing to the next stage and, therefore, being repelled by the corona electrodes of the next stage, which repulsion would retard the rate of fluid flow. The corona discharge device can be any such device that is known in the art but is preferably one utilizing the construction discussed above for increasing the density of ions.

A further optional technique for maximizing the density of ions is having a high-voltage power supply with a variable maximum voltage that depends on the corona current, which is defined as the total current from the corona electrode to any other electrode. The output voltage of the high-voltage power supply is inversely proportional to the corona current. Therefore, the voltage applied to the corona electrodes is reduced sufficiently, when the corona current indicates that a breakdown is imminent, that such breakdown is precluded. Without this option, the voltage between the corona electrodes and the other electrodes (except, of course, repelling electrodes, where no corona discharge is desired) must be manually maintained between the corona inception voltage and the breakdown voltage to have a sufficient electric field strength to create a corona discharge between the corona electrodes and the other electrodes without causing a spark-producing breakdown that would preclude the creation of the desired ions. The closer the voltage between such electrodes approaches, without actually attaining, the breakdown voltage, however, the greater will be the density of the ions that are generated.

The voltage applied to any electrode other than the corona electrode can, furthermore, also be used to control the direction of movement of the ions and, therefore, of the fluid. If desired, electrodes may be introduced for this purpose alone.

DESCRIPTION OF THE PREFERRED EMBODIMENT

Figure 1:
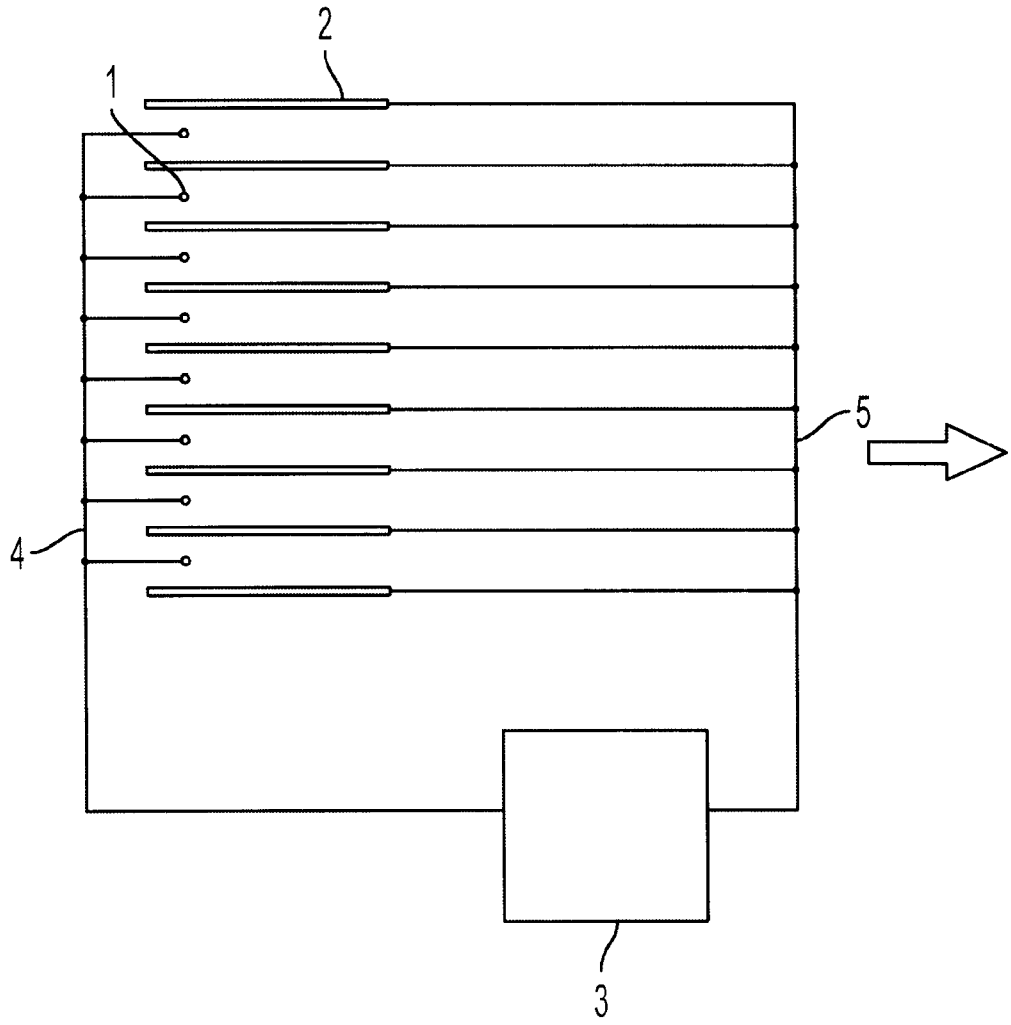
FIG. 1 illustrates schematically, by the way of example, a multiple corona and exciting electrodes arrangement.

In order to successfully create the desired rate of fluid flow, the high-voltage power supply should generate an output voltage that is higher than the corona onset voltage but, no matter what the surrounding environmental conditions, below the breakdown voltage.

To prevent a breakdown between electrodes, the high-voltage power supply should be sensitive to conditions that affect the breakdown voltage, such as humidity, temperature, etc. and reduce the output voltage to a level below the breakdown point.

Achieving this goal could require a rather costly high-voltage power supply with voltage and other sensors as well as a feedback loop control.

However, it was experimentally determined by the inventors that the corona current depends on the same conditions which affect the breakdown voltage. Thus, as indicated above, the voltage between the corona electrode and other electrodes (except the repelling electrodes, for which a corona discharge is not desired) should be maintained between the corona onset voltage and the breakdown voltage; and a preferred technique for maximizing the density of ions without having a breakdown, no matter what the surrounding environmental conditions are, is to utilize a high-voltage power supply with a variable maximum voltage that is inversely proportional to the corona current.

Such a high-voltage power supply is termed a "flexible top" high-voltage power supply.

The "flexible top" high-voltage power supply preferably consists of two power supply units connected in series. The first unit, which is termed the "base unit," generates an output voltage, termed the "base voltage," which is close to (above or below) the corona onset voltage and below the breakdown voltage and which, because of a low internal impedance in the unit, is only slightly sensitive to the output current. The second unit, which is termed the "flexible top," generates an output voltage that is much more sensitive to the output current than is the voltage of the base unit, i.e., the base voltage, because of a large internal impedance. If output current increases, the base voltage will remain almost constant whereas the output voltage from the flexible top decreases. It is a matter of ordinary skill in the art to select the values of circuit components which will assure that, for any foreseeable environmental conditions, the combined resultant output voltage from the base unit and the flexible top will be greater than the corona onset voltage but less than the breakdown voltage.

Moreover, once the need for the flexible top has been recognized, ordinary skill in the art can supply various methods of achieving such a power supply.

Perhaps, the simplest example of the flexible top high-voltage power supply is the following: A traditional high-voltage power supply is used for the base unit, and a step-up transformer with larger leakage inductance is employed in the flexible top. The alternating current flows through the leakage inductance, thereby creating a voltage drop across such inductance. The more current that is drawn, the more voltage drops across the leakage inductance; and the more voltage that is dropped across the leakage inductor, the less is the output voltage of the flexible top.

Figure 6:
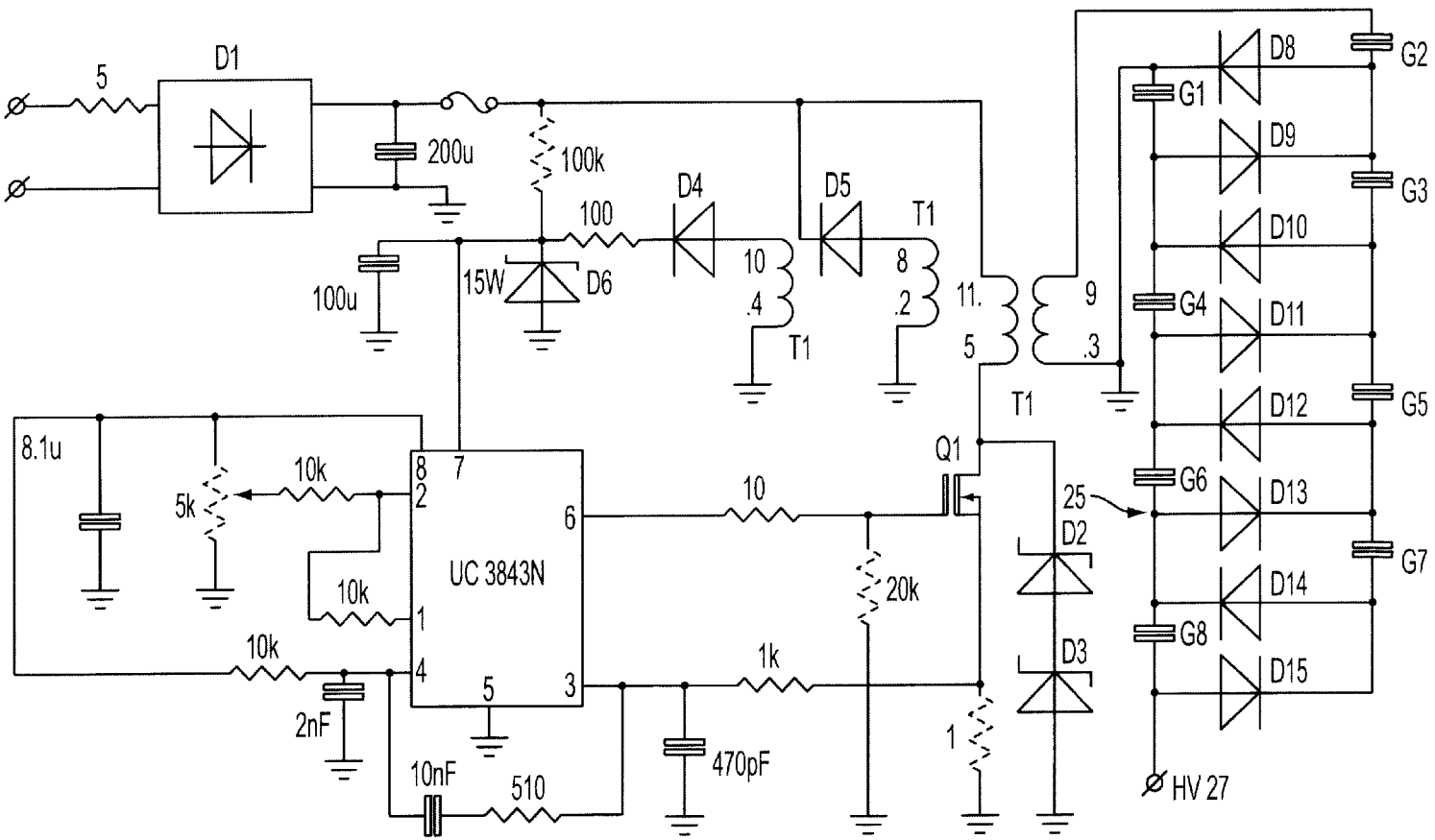
FIG. 6 illustrates schematically, by the way of example, a flexible top power supply circuit diagram.

A second example of a flexible top high-voltage power supply utilizies a combination of capacitors of a voltage multiplier as depicted in FIG. 6. The first set of capacitors have a much greater capactitance and, therefore, much lower impedance than the second set. Therefore, the voltage across the first set of capacitors (the base unit) is relatively insensitive to the current whereas the voltage across the second set of capacitors (the flexible top) is inversely proportional to the current.

It will be appreciated that a flexible top high-voltage power supply is any combination of bases units and flexible tops connected in series that do not depart from the spirit of the invention. Therefore, the flexible top high-voltage power supply may consist of any number of base units and flexible tops connected in series in any desired order so that the resultant output voltage is within the desired range.

The Electrostatic Fluid Accelerator of the present invention, thus, comprises a multiplicity of closely spaced corona electrodes with an exciting electrode asymmetrically located between the corona electrodes. A flexible top high-voltage power supply preferably controls the voltage between the corona electrodes and the exciting electrodes so that such voltage is maintained between the corona onset voltage and the breakdown voltage.

Optionally, however, the voltage between the corona electrodes and the exciting electrodes can be varied even outside the preceding range in order to vary the flow of the fluid which it is desired to move.

And in lieu of locating the exciting electrode asymmetrically between the corona electrodes, the Electrostatic Fluid Accelerator may further comprise an accelerating electrode.

The accelerating electrode may, as discussed above, either be an attracting electrode, a repelling electrode, or a combination of attracting and repelling electrodes.

An attracting electrode has electric polarity opposite to that of the corona electrode and is located, with respect to the desired direction of fluid flow, downstream from the corona electrode. The repelling electrode has the same electrical polarity as the corona electrode and is situated, with respect to the desired direction of fluid flow, upstream from the corona electrode.

To assure that more ions and, consequently, more fluid particles, flow downstream, the exciting electrode can be constructed in the form of a plate that extends downstream with respect to the desired direction of fluid flow.

Finally, as discussed above, in order to achieve the greatest flow of fluid, multiple stages of corona discharge devices, and preferably the Electrostatic Fluid Accelerator of the present invention, are used with a collecting electrode placed between each stage. The collecting electrode has opposite electrical polarity to that of the corona electrodes and is designed to preclude substantially all ions and other electrically charged particles from passing to the next stage, where they would tend to be repelled and thereby impair the movement of the fluid. Preferably, the collecting electrode is a wire mesh that extends substantially across the intended path for the fluid particles.

FIG. 1 illustrates schematically a first embodiment of electrostatic fluid accelerator according to the invention which comprises multiple corona electrodes 1, multiple exciting electrodes 2, power supply 3. Corona electrodes 1 and exciting electrodes 2 are connected to the respective terminals of the power supply 3 by the means of conductors 4 and 5. The desired fluid flow is shown by an arrow. Corona electrodes 1 are located asymmetrically between exciting electrodes 2 with respect to the desired fluid flow. In the illustrated embodiment is assumed that corona electrodes 1 are wire-like electrodes (shown in cross section), exciting electrodes 2 are plate-like electrodes (also shown in cross section) and a power supply 3 is a DC power supply. It will be understood that corona electrodes may be of any shape that ensures corona discharge and subsequent ion emission from one or more parts of said corona electrode. In general corona electrodes may be made in shape of needle, barbed wire, serrated plates or plates having sharp or thin parts that facilitate electric field raise at the vicinity of these parts of the corona electrodes. It will be understood that power supply may generate any voltage (direct, alternating or pulse) that has a magnitude great enough to raise an electric filed strength at the vicinity of the corona electrodes 1 above corona onset value. In accordance with the present invention, the corona electrodes 1, exciting electrodes 2 and conductors 4 and 5 of the embodiment illustrated in FIG. 1 are made of electrically conductive material that is capable to conduct a desired electrical current to the ion emitting parts of the corona electrodes and to the exciting electrodes. Corona electrodes 1 are supported by a frame (not shown) that ensures the corona electrodes 1 being parallel to the exciting electrodes 2. Power supply 3 generates voltage that creates an electric field in the space between the corona electrodes 1 and exciting electrodes 2. This electric field receives a maximum magnitude in the vicinity of the corona electrodes 1. When maximum magnitude of the electric field exceeds a corona onset voltage the corona electrodes 1 emit ions. Ions being emitted from the corona electrodes 1 are attracted to the exciting electrodes 2. Due to asymmetrical location of the corona electrodes 1 and the exciting electrodes 2 ions receive more acceleration toward the desired fluid flow shown by an arrow. More ions will therefore flow to the right (as shown in FIG. 1) than to the left. Ion movement to the direction of the desired fluid flow creates fluid flow to this direction due to ions' collision with the fluid molecules.

Figure 2:
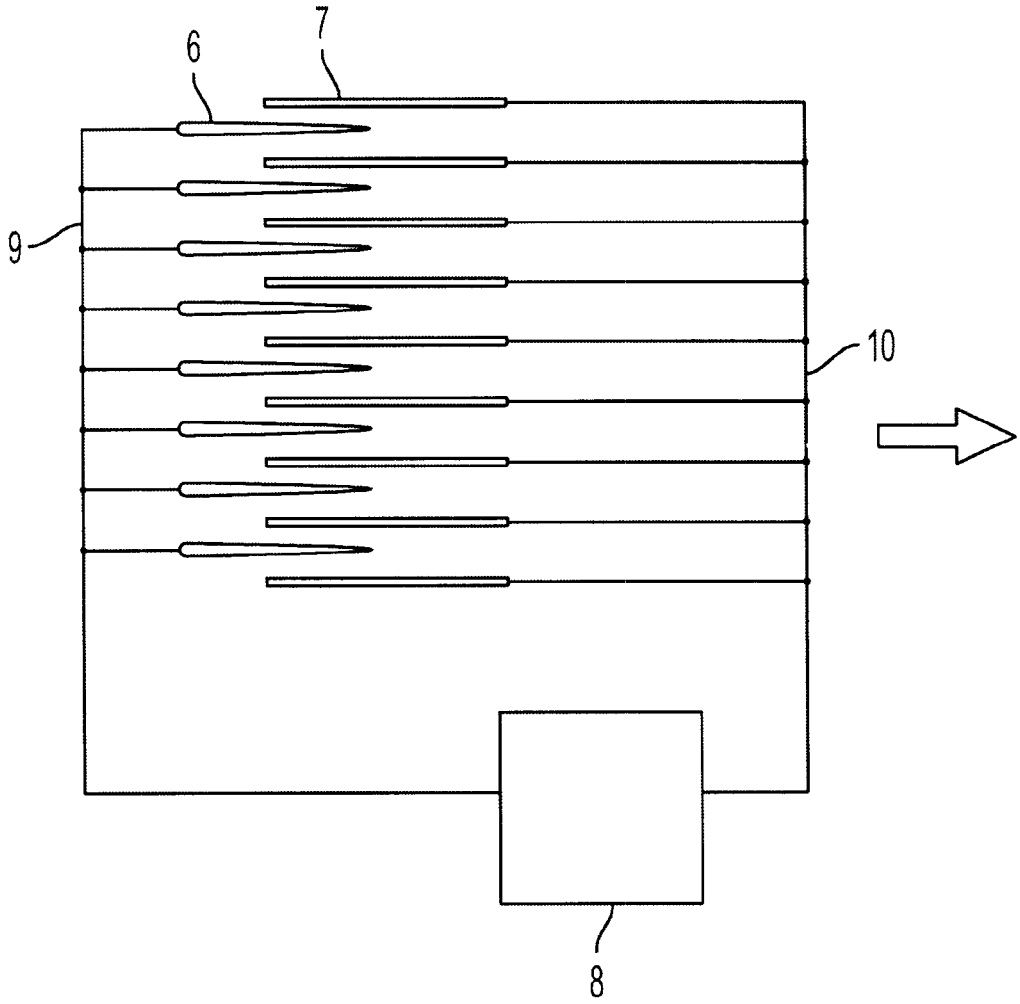
FIG. 2 illustrates schematically, by the way of example, another implementation of multiple corona and exciting electrodes arrangement.

FIG. 2 illustrates schematically a second embodiment of electrostatic fluid accelerator according to the invention which comprises multiple corona electrodes 6, multiple exciting electrodes 7, power supply 8. Corona electrodes 6 and exciting electrodes 7 are connected to the respective terminals of the power supply 8 by the means of conductors 9 and 10. The desired fluid flow is shown by an arrow. Corona electrodes 6 are located asymmetrically between exciting electrodes 7 with respect to the desired fluid flow. Corona electrodes 6 and exciting electrodes 7 are connected to the respective terminals of the power supply 8 by the means of conductors 9 and 10. The desired fluid flow is shown by an arrow. Corona electrodes 6 are located asymmetrically between exciting electrodes 7 with respect to the desired fluid flow. In the illustrated embodiment is assumed that corona electrodes 6 are razor-like electrodes (shown in cross section), exciting electrodes 7 are plate-like electrodes (also shown in cross section) and a power supply 8 is a DC power supply. It will be understood FIG. 2 may as well represent the corona electrodes 6 in a shape of needles and the exciting electrodes 7 located asymmetrically between the corona needle-like electrodes. The preferred shape of the exciting electrodes 7 will be, but not limited to, honeycomb that separate the corona electrodes 6 from each other, said corona electrodes are located near the center of the honeycomb-like exciting electrodes. The power supply 8 may, as in previous embodiment generate any voltage (direct, alternating or pulse) that has a magnitude great enough to raise an electric filed strength at the vicinity of the parts of the corona electrodes 6 that exceeds a corona onset value. In accordance with the present invention, the corona electrodes 6, exciting electrodes 7 and conductors 9 and 10 of the embodiment illustrated in FIG. 2 are made of electrically conductive material that is capable to conduct a desired electrical current to the ion emitting parts of the corona electrodes 6 to the exciting electrodes 7. Corona electrodes 6 are supported by a frame (not shown) that ensures the corona electrodes 6 being parallel to the exciting electrodes 7. Power supply 8 generates voltage that creates an electric field in the space between the corona electrodes 6 and exciting electrodes 7. This electric field receives a maximum magnitude in the vicinity of the sharp edges (or sharp points in case of needle-like corona electrodes) of the corona electrodes 6. When maximum magnitude of the electric field exceeds a corona onset voltage the corona electrodes 6 emit ions. Ions being emitted from the sharp edges (or points) of the corona electrodes 6 are attracted to the exciting electrodes 7. Due to asymmetrical location of the corona electrodes 6 and the exciting electrodes 7 ions receive more acceleration toward the desired fluid flow shown by an arrow. More ions will therefore flow to the right (as shown in FIG. 2) than to the left. Ions' movement to the direction of the desired fluid flow creates fluid flow to this direction due to ions' collision with the fluid molecules.

Figure 3:
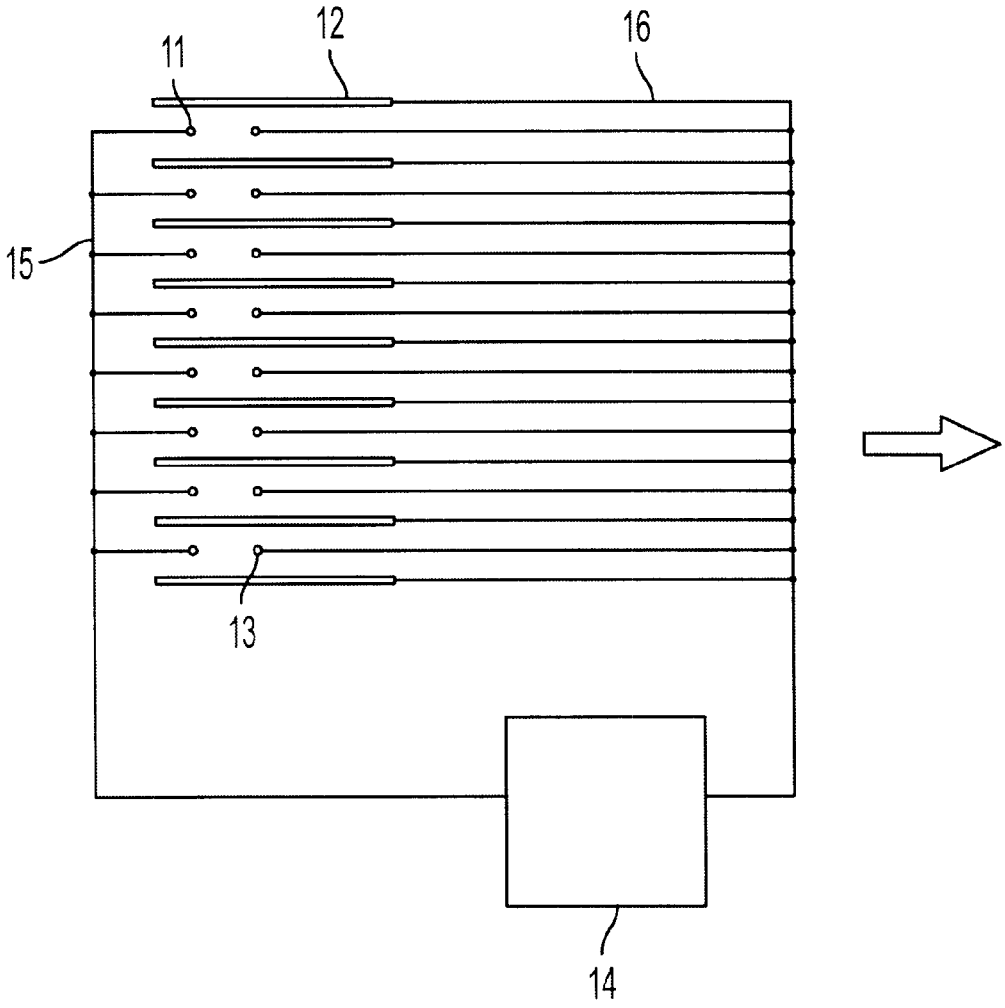
FIG. 3 illustrates schematically, by the way of example, a multiple corona and exciting electrodes arrangement including multiple attracting electrodes arrangement.

FIG. 3 illustrates schematically a third embodiment of electrostatic fluid accelerator according to the invention which comprises multiple corona electrodes 11, multiple exciting electrodes 12, multiple attracting electrodes 13, power supply 14. Corona electrodes 11 from one hand and exciting electrodes 12 and attracting electrodes 13 from other hand are connected to the respective terminals of the power supply 14 by the means of conductors 15 and 16. The desired fluid flow is shown by an arrow. Corona electrodes 11 are located between exciting electrodes 12 and separated by the last from each other. As an example wire-like corona electrodes 11 are shown in cross section, exciting electrodes 12 are plate-like electrodes and attracting electrodes 13 are wire-like or rod-like electrodes (also shown in cross section) and a power supply 14 is a DC power supply. It will be understood FIG. 3 may as well represent the corona electrodes 11 in any other shape that ensures electric field strength in the vicinity of the corona electrodes 11 great enough to initiate corona discharge. The power supply 14 may, as in previous embodiments (FIG. 1 and FIG. 2) generate any voltage (direct, alternating or pulse) that has a magnitude great enough to raise an electric field strength at the vicinity of the parts of the corona electrodes 11 that exceeds a corona onset value. In accordance with the present invention, the corona electrodes 11, exciting electrodes 12, attracting electrodes 13 and conductors 15 and 16 of the embodiment illustrated in FIG. 3 are made of electrically conductive material that is capable of conducting a desired electrical current to the ion emitting parts of the corona electrodes to the exciting electrodes 12 and to the attracting electrodes 13. Corona electrodes 1I1 are supported by a frame (not shown) that ensures the corona electrodes 11 being substantially parallel to the exciting electrodes 12 and to the attracting electrodes 13. Power supply 14 generates voltage that creates an electric field in the space between the corona electrodes 11 and exciting electrodes 12 and the attracting electrodes 13. This electric field receives a maximum magnitude in the vicinity of the corona electrodes 11 (or sharp edges or sharp points in case of razor-like or needle-like corona electrodes). When the maximum magnitude of the electric field exceeds a corona onset voltage the corona electrodes 11 emit ions. Ions being emitted from the sharp edges (or points) of the corona electrodes 11 are attracted to the exciting electrodes 12 and to the attracting electrodes 13. Due to electrostatic force ions receive acceleration toward the desired fluid flow shown by an arrow. Ions will therefore flow to the right (as shown in FIG. 3). Ions' movement in the direction of the desired fluid flow creates fluid flow in this direction due to ions' collision with the fluid molecules.

Figure 4:
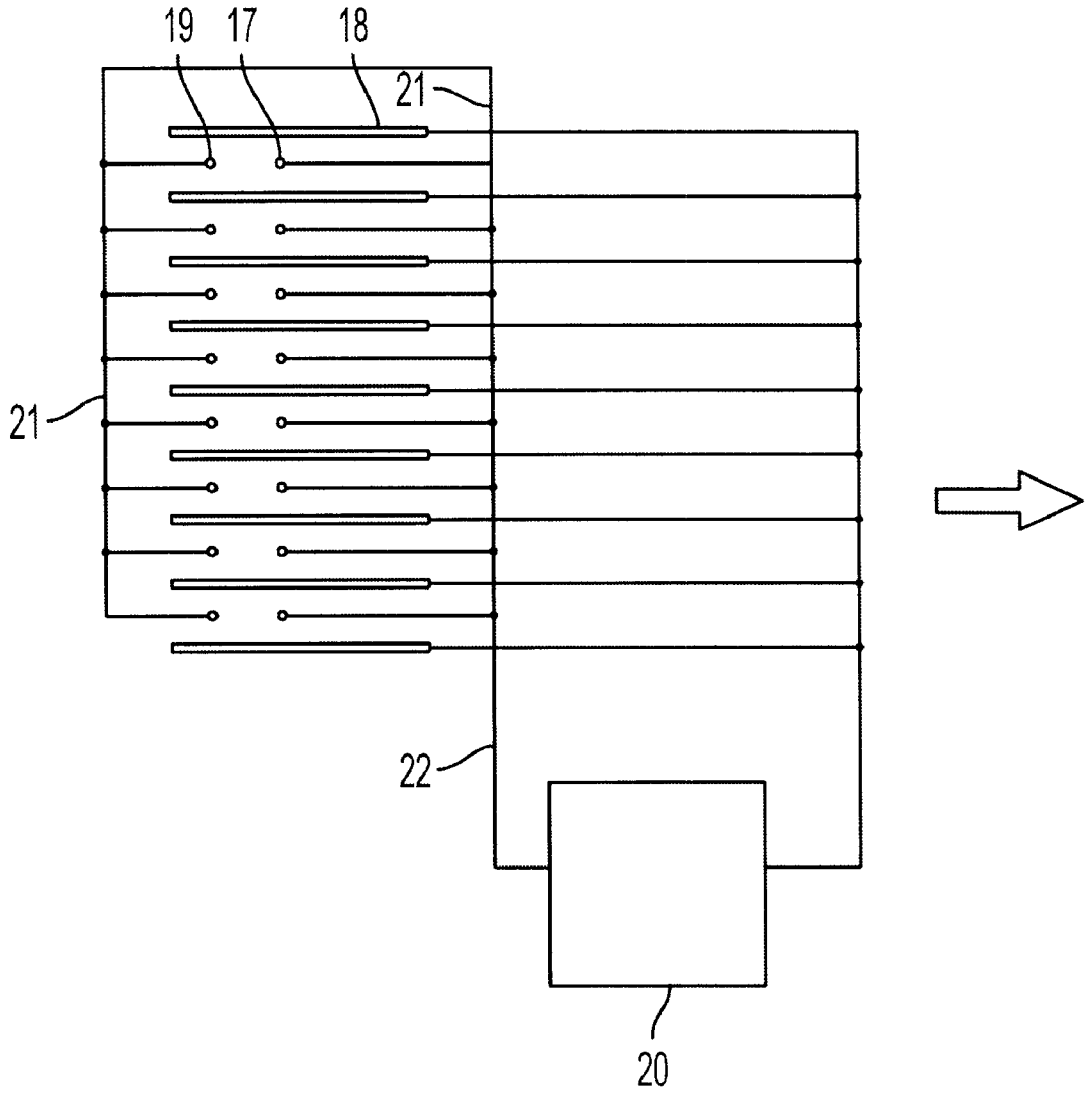
FIG. 4 illustrates schematically, by the way of example, a multiple corona and exciting electrodes arrangement including multiple repelling electrodes arrangement.

FIG. 4 illustrates schematically a fourth embodiment of electrostatic fluid accelerator according to the invention which comprises multiple corona electrodes 17, multiple exciting electrodes 18, multiple repelling electrodes 19, power supply 20. Corona electrodes 17 together with repelling electrodes 19 from one hand and exciting electrodes 18 from other hand are connected to the respective terminals of the power supply 20 by the means of conductors 21 and 22. The desired fluid flow is shown by an arrow. Corona electrodes 17 are located between exciting electrodes 18 and separated by the latter from each other. As an example wire-like corona electrodes 17 are shown in cross section, exciting electrodes 18 are plate-like electrodes and repelling electrodes 19 are wire-like or rod-like electrodes (also shown in cross section) and a power supply 20 is a DC power supply. It will be understood FIG. 4 may as well represent the corona electrodes 17 in any other shape that ensures electric field strength in the vicinity of the corona electrodes 17 great enough to initiate corona discharge. The power supply 20 may, as in previous embodiments generate any voltage (direct, alternating or pulse) that has a magnitude great enough to raise an electric field strength at the vicinity of the parts of the corona electrodes 17 that exceeds a corona onset value. In accordance with the present invention, the corona electrodes 17, exciting electrodes 18, repelling electrodes 19 and conductors 21 and 22 of the embodiment illustrated in FIG. 4 are made of electrically conductive material that is capable to conduct a desired electrical current to the ion emitting parts of the corona electrodes to the exciting electrodes 17. Corona electrodes 17 are supported by a frame (not shown) that ensures the corona electrodes 17 being substantially parallel to the exciting electrodes 18 and to the repelling electrodes 19. Power supply 20 generates voltage that creates an electric field in the space between the corona electrodes 17 and exciting electrodes 18. This electric field receives a maximum magnitude in the vicinity of the corona electrodes 17 (or sharp edges or sharp points in case of razor-like or needle-like corona electrodes). When maximum magnitude of the electric field exceeds a corona onset voltage the corona electrodes 17 emit ions. Ions being emitted from the sharp edges (or points) of the corona electrodes 17 are attracted to the exciting electrodes 18 and at the same time are repelled from repelling electrodes 19. Due to electrostatic force ions receive acceleration toward the desired fluid flow shown by an arrow. Ions will therefore flow to the right (as shown in FIG. 4). Ions' movement to the direction of the desired fluid flow creates fluid flow to this direction due to ions' collision with the fluid molecules. It will be understood that the repelling electrodes 19 may be made of any shape that ensures that an electric strength in the vicinity of the repelling electrodes 19 is below corona onset value. To ensure that comparatively low value the repelling electrodes 19 may be made of greater main size than the corona electrodes 17. As another option the repelling electrodes 19 may not have sharp edges or do not have serrated surface.

Figure 5:
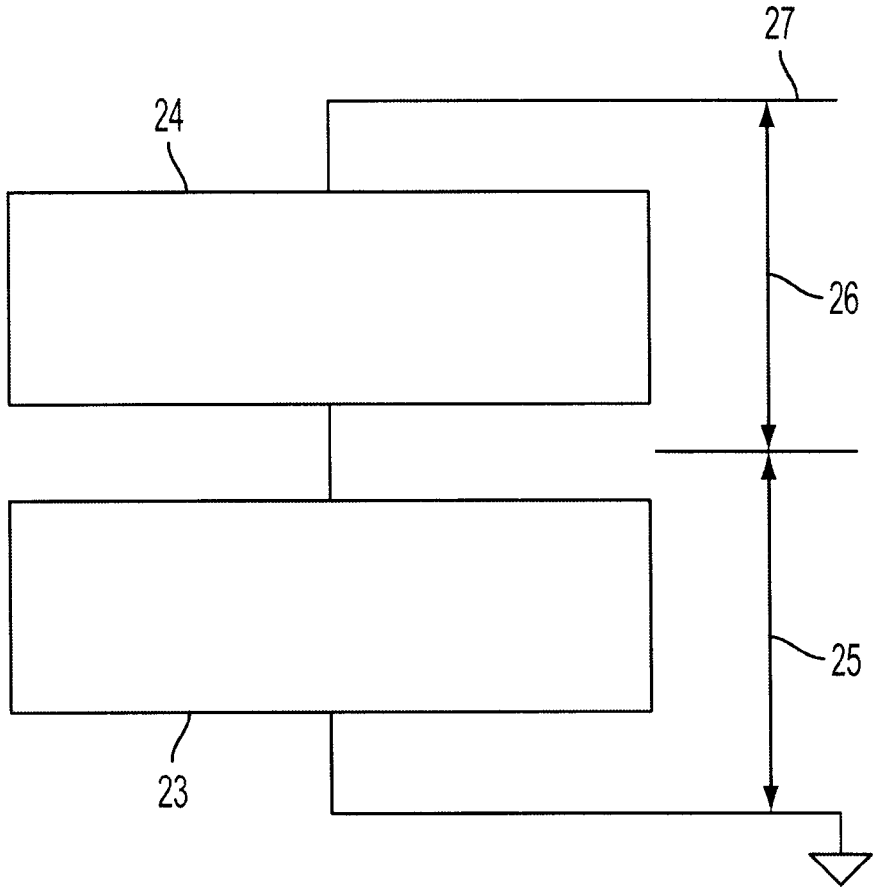
FIG. 5 illustrates schematically, by the way of example, a flexible top power supply flow diagram.

FIG. 5 illustrates schematically flexible top power supply flow diagram. According to the invention the power supply consists of two functional parts—base part 23 and flexible part 24. The base part 24 produces output voltage 25 and flexible top part 24 produces output voltage 26. Both voltages 25 and 26 gives output voltage of power supply that is equal to their sum, i.e. 27. Each part of power supply in FIG. 5 may be made of any of known design. It may be a transformer-rectifier, or voltage multiplier, or fly-back configuration, or combination of the above. The base part 23 and flexible top part 24 may be of similar of different design as well. The only difference between the base part 23 and the flexible top part 24 that is relevant to the purpose of this invention is the dependence of output voltage of output current. The base part 23 generates output voltage 25 that is less dependent on output current. The flexible top part 24 generates output voltage 26 that drops significantly with output current increase. The base part 23 generates output voltage 25 that is close to the corona onset voltage of the corona electrodes. This voltage 25 may be equal to the corona onset voltage or it may be slightly more or less than that corona onset voltage. This corona onset voltage depends on the electrodes geometry and environment as well. It is experimentally determined that the corona onset voltage has smaller value under higher temperature. From the other hand the base voltage 25 should not be greater than breakdown voltage between the corona and other electrodes. This breakdown voltage also varies with temperature and other factors. Therefore it is desirable to maintain voltage 25 at the level that is close to the corona onset voltage but does not exceed breakdown voltage under any environment condition specific for an application. The flexible part 24 generates output voltage that in combination with the voltage 25 gives total output voltage 27 that is greater than corona onset voltage but lesser than breakdown voltage. It is experimentally determined that corona current depends of the voltage between the electrodes nonlinearly. Corona current starts at the corona onset voltage and reaches maximum value as the voltage approaches a breakdown level. To ensure that total output voltage of power supply will never reach a breakdown level output voltage 26 decreases as the corona current approaches its maximum value. At the same time total output voltage 27 will always be above corona onset level. This ensures corona discharge and fluid flow at any condition.

FIG. 6 illustrates flexible top power supply circuit diagram. Power supply shown in FIG. 6 generates high voltage at the level between 10,000V and 15,000V. Power train of this power supply consists of power transistor Q1, High Voltage fly-back inductor T1 and voltage multiplier (capacitors C1–C8 and diodes D8–D15). Pulse Width Modulator Integrated Circuit UC3843N periodically switches transistor Q1 ON and OFF with frequency that exceeds audible frequency to ensure silent operation. Potentiometer 5*k* controls duty cycle and is used for output voltage control. Shunt 1 Ohm connected between Q1 source and ground senses output current and turns transistor Q1 OFF if current exceeds preset level. The preset level in power supply shown in FIG. 6 is equal approximately 1A. Capacitors C1–C6 have value that exceeds the value of the capacitors C8–C7. The sum of the voltages across capacitors C1, C4 and C6 constitutes the base voltage 25. The voltage across capacitor C8 represents the flexible top voltage 26. The sum of the voltages 25 and 26 represents output voltage 27 of the flexible top power supply. It will be understood that any configuration of power supply of a combination of power supplies that consists of one or more base parts or power supplies and one or more parts or flexible top power supplies falls under spirit of this invention. As an another example of such flexible top power supply simplest transformer-rectifier configuration may be considered (not shown here). The transformer may consist of a primary winding and at least two secondary windings. Each secondary winding is connected to a separate rectifier. The DC outputs of these rectifiers are connected in series. One of the secondary windings has greater leakage inductance with respect to the primary winding than the leakage inductance of another secondary winding with respect to the primary winding. When a corona current grows voltage drop across that greater leakage inductance grows and output voltage of the power supply decreases to safe level.

Figure 7:
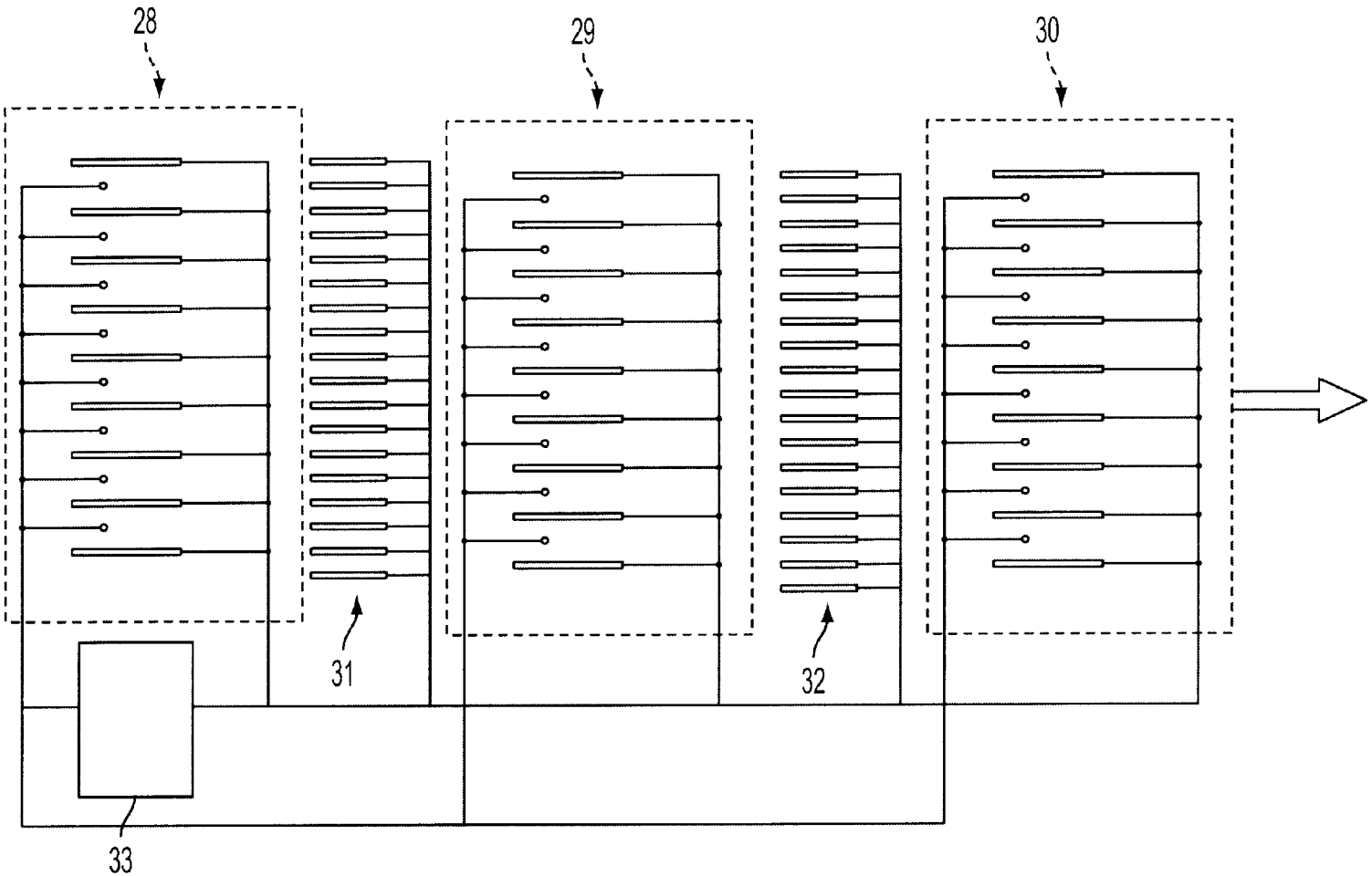
FIG. 7 illustrates schematically, by the way of example, several stages of electrostatic fluid accelerators placed in series with respect to the desired fluid flow.

FIG. 7 illustrates several stages 28, 29 and 30 of an electrostatic fluid accelerators placed in series with respect to the desired fluid flow. In accordance to the present invention each stage is separated from another stage by the collecting electrodes 31 and 32. Each stage 28, 29 and 30 are powered by power supply 33 and accelerate fluid by generating ions at corona discharge and then accelerating ions toward the desired fluid flow (shown by the arrow). Ions and other charged particles travel from the vicinity of the corona electrodes through the area surrounded by the exciting electrodes and toward next stage. Part of these ions and particles settle on the exciting electrodes. Part of these particles, however, travel beyond the electrodes of a particular stage. These ions and particles go as far as to the next stage and repel from the corona electrodes of the next stage. Ions and particles slow their movement toward the desired fluid movement and even travel back in the opposite direction. This event decreases total fluid velocity and fluid accelerator efficiency. To prevent such an event collecting electrodes 31 and 32 are installed in between of the stages. These collecting electrodes are placed close to each other and connected to the polarity that is opposite to the polarity of the corona electrodes. Ions and charged particles that travel beyond the stages are attracted to the collecting electrodes 31 and 32 and give their charge to these electrodes. By that means no or almost no charged particles travel to the next stage. In the FIG. 7 all collecting electrodes are connected to the same power supply 33 terminal as the exciting electrodes of the stage 28, 29 and 30. It will be understood that these collecting electrodes may be connected to or be under any electric potential that is opposite to the potential of the corona electrodes. It will be understood that some of the electrodes may be connected to different power supplies including variable power supplies.

Figure 8:
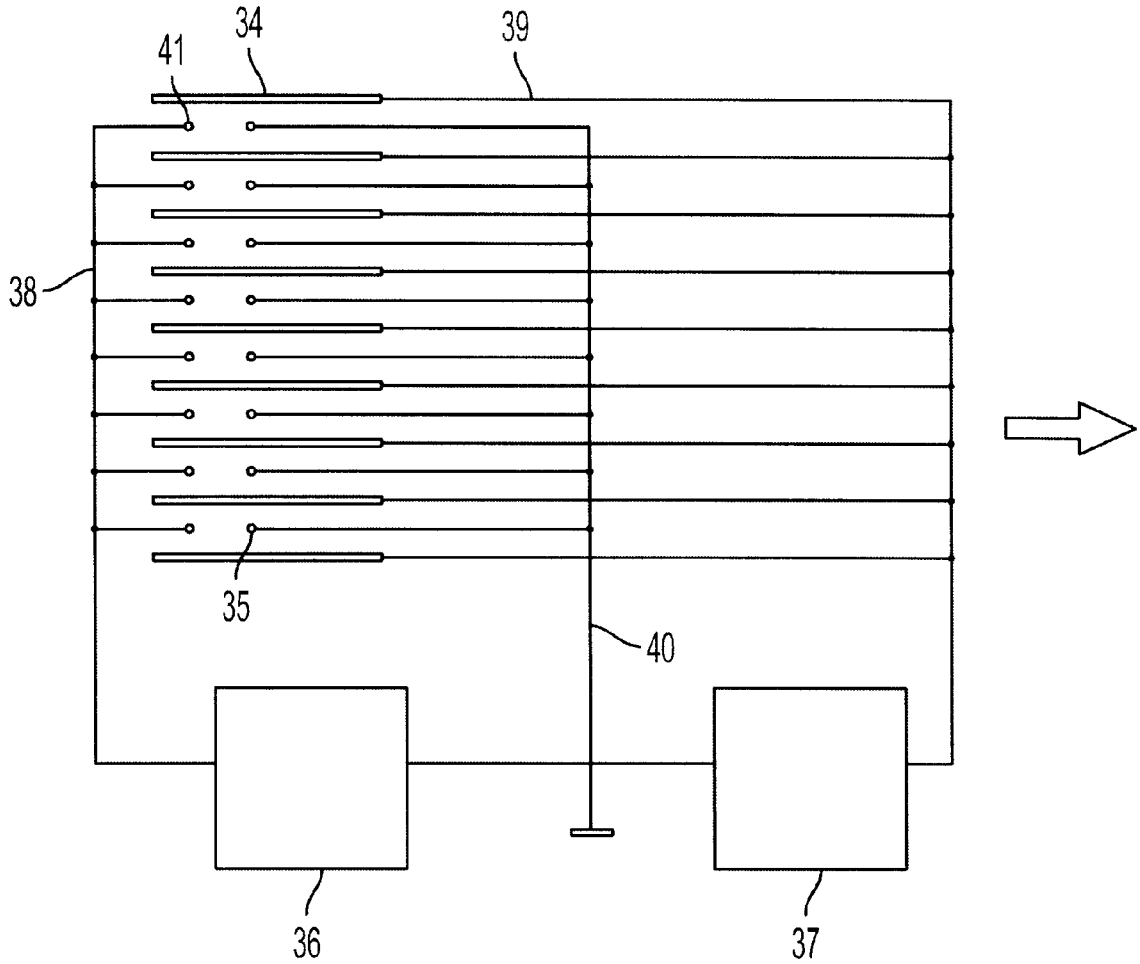
FIG. 8 illustrates schematically, by the way of example, an electrostatic fluid accelerator that is capable of controlling fluid flow by changing a potential at the exciting electrodes.

FIG. 8 illustrates electrostatic fluid accelerator that is capable to control fluid flow by changing a potential at the exciting electrodes. The electrostatic fluid accelerator shown in FIG. 8 consists of multiple corona electrodes 41, multiple exciting electrodes 34 and multiple attracting electrodes 35. The geometry and mutual locating of all the electrodes is similar to what is shown in FIG. 3. The electrostatic fluid generator shown in FIG. 8 is powered by two power supplies. The attracting electrodes 35 are connected to the common point of the two power supplies. This common point is shown as a ground, but may be at any arbitrary electric potential. Power supply 36 is connected to the common point by means of conductors 40 and to the corona electrodes 41 by the mean of conductors 38. Power supply 36 produces stable DC voltage. Power supply 37 is connected to the common point by conductors 40 and to the exciting electrodes by conductors 39. Power supply 37 produces variable DC voltage.

If electric field strength in the area between the corona electrodes 41 and the exciting electrodes 34 is approximately equal to the electric field strength in the area between the corona electrodes 41 and the attracting electrodes 35 the electric current's magnitude that flows from the corona electrodes 41 to the exciting electrodes 34 is approximately equal to the electric current's magnitude that flows from the corona electrodes 41 to the attracting electrodes 35. It is experimentally determined that approximately equal electric field strength is most favorable for the corona discharge for the described electrodes geometry and mutual location. It was further determined that when the electric field strength in the area between the corona electrodes 41 and the exciting electrodes 34 is less than that of the electric field strength in the area between the corona electrodes 41 and the attracting electrodes 35 the corona discharge is suppressed and fewer ions are emitted from the corona discharge. When electric field strength in the area between the corona electrodes 41 and the exciting electrodes 34 is approximately half of the electric field strength in the area between the corona electrodes 41 and the attracting electrodes 35 the corona discharge is almost totally suppressed and almost no or fewer ions are emitted from the corona discharge and no fluid movement is detected.

It will be understood that because of nature of a corona discharge a flexible top power supply may be successfully used with any combination of electrodes for corona discharge initiating and maintenance.

It will be further understood that any set of multiple electrodes may be located and/or secured on the separate frame. This frame must have an opening through which fluid freely flows. It may be a rectangular frame or u-shape frame or any other. Two or more frames on which the multiple set of the electrodes is located are then secured in the manner that ensures sufficient distance along the surface to prevent so called creeping discharge along this surface.

The above arrangements were successfully tested. The distance between exciting electrodes was 2 to 5 mm., the diameter of the corona electrodes was 0.1 mm and the exciting electrodes' width was about 12 mm. The attracting electrodes' diameter was 0.75 mm. The corona electrodes were made of tungsten wire while the exciting electrodes were made of aluminum foil, and the exciting electrodes were made of brass and steel rods. At a voltage for the corona electrodes (the exciting and attracting electrodes being grounded) in the magnitude of 2,000 volts to 7,500 volts, air flow was measured at a maximum rate of 950 feet per minute. In terms of the voltage applied to the exciting electrodes, air flow was at a maximum value when the exciting electrodes' potential was close to voltage of the attracting electrodes. When the potential at the exciting electrodes approached the potential of the corona electrodes, the air flow decreased and eventually dropped to an undetectable level.

We claim:

1. An electrostatic fluid accelerator comprising:

a multiplicity of closely spaced corona electrodes; and at least one exciting electrode shaped as a plate extending downstream with respect to a desired fluid flow direction, said at least one exciting electrode asymmetrically located between said corona electrodes with respect to said desired fluid flow direction such that a desired fluid flow is generated in said desired fluid flow direction.

2. The electrostatic fluid accelerator as recited in claim 1, wherein:

a voltage between said corona electrodes and said exciting electrodes is variable, even outside the range between the corona onset voltage and the breakdown voltage.

3. The electrostatic fluid accelerator as recited in claim 2, further comprising:

one or more additional sets of a multiplicity of closely spaced corona electrodes and at least one exciting electrode; and at least one collecting electrode located between at least two consecutive sets.

4. The electrostatic fluid accelerator as recited in claim 1, wherein:

a voltage between said corona electrodes and said exciting electrodes is maintained between the corona onset voltage and the breakdown voltage.

5. The electrostatic fluid accelerator as recited in claim 4, further comprising:

one or more additional sets of a multiplicity of closely spaced corona electrodes and at least one exciting electrode; and at least one collecting electrode located between at least two consecutive sets.

6. The electrostatic fluid accelerator as recited in claim 4, wherein:

the voltage between said corona electrodes and said exciting electrodes is controlled by a flexible top high-voltage power supply.

7. The electrostatic fluid accelerator as recited in claim 6, further comprising:

one or more additional sets of a multiplicity of closely spaced corona electrodes and at least one exciting electrode; and at least one collecting electrode located between at least two consecutive sets.

8. An electrostatic fluid accelerator comprising:

a multiplicity of closely spaced corona electrodes;

a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and at least one accelerating electrode located downstream from said corona electrodes with respect to said desired fluid flow direction.

9. The electrostatic fluid accelerator as recited in claim 8, wherein:

a voltage between said corona electrodes and said accelerating electrodes is maintained between the corona onset voltage and the breakdown voltage.

10. The electrostatic fluid accelerator as recited in claim 9, wherein:

a voltage between said corona electrodes and said exciting electrodes is variable, even outside the range between the corona onset voltage and the breakdown voltage.

11. The electrostatic fluid accelerator as recited in claim 10, wherein:

the accelerating electrode is an attracting electrode, said attracting electrode having opposite electrical polarity to that of said corona electrodes and said attracting electrode being located, with respect to the desired direction of fluid flow, downstream from said corona electrodes.

12. The electrostatic fluid accelerator as recited in claim 11, further comprising:

one or more additional sets of a multiplicity of closely spaced corona electrodes and at least one exciting electrode; and at least one collecting electrode located between at least two consecutive sets.

13. The electrostatic fluid accelerator as recited in claim 10, wherein:

the accelerating electrode is a repelling electrode, said repelling electrode having the same electrical polarity as that of said corona electrodes and said repelling electrode being located, with respect to the desired direction of fluid flow, upstream from said corona electrodes.

14. The electrostatic fluid accelerator as recited in claim 13, further comprising:

one or more additional sets of a multiplicity of closely spaced corona electrodes and at least one exciting electrode; and at least one collecting electrode located between at least two consecutive sets.

15. The electrostatic fluid accelerator as recited in claim 8, wherein:

a voltage between said corona electrodes and sad exciting electrodes is maintained between a corona onset voltage and a breakdown voltage.

16. The electrostatic fluid accelerator as recited in claim 15, wherein:

the accelerating electrode is an attracting electrode, said attracting electrode having opposite electrical polarity to that of said corona electrodes and said attracting electrode being located, with respect to the desired direction of fluid flow, downstream from said corona electrodes.

17. The electrostatic fluid accelerator as recited in claim 16, further comprising:

one or more additional sets of a multiplicity of closely spaced corona electrodes and at least one exciting electrode; and at least one collecting electrode located between at least two consecutive sets.

18. The electrostatic fluid accelerator as recited in claim 16, wherein:

a voltage between said corona electrodes and said exciting electrode is controlled by a flexible top high-voltage power supply.

19. The electrostatic fluid accelerator as recited in claim 18, further comprising:

one or more additional sets of a multiplicity of closely spaced corona electrodes and at least one exciting electrode; and at least one collecting electrode located between at least two consecutive sets.

20. The electrostatic fluid accelerator as recited in claim 13, wherein:

the accelerating electrode is a repelling electrode, said repelling electrode having the same electrical polarity as that of said corona electrodes and said repelling electrode being located, with respect to the desired direction of fluid flow, upstream from said corona electrodes.

21. The electrostatic fluid accelerator as recited in claim 20, further comprising:

one or more additional sets of a multiplicity of closely spaced corona electrodes and at least one exciting electrode; and at least one collecting electrode located between at least two consecutive sets.

22. The electrostatic fluid accelerator as recited in claim 20, wherein:

a voltage between said corona electrodes and said exciting electrode is controlled by a flexible top high-voltage power supply.

23. The electrostatic fluid accelerator as recited in claim 22, further comprising:

one or more additional sets of a multiplicity of closely spaced corona electrodes and at least one exciting electrode; and at least one collecting electrode located between at least two consecutive sets.

24. The electrostatic fluid accelerator as recited in claim 20, wherein:

said exciting electrode is a plate that extends downstream with respect to the desired direction of fluid flow.

25. The electrostatic fluid accelerator as recited in claim 24, further comprising:

one or more additional sets of a multiplicity of closely spaced corona electrodes and at least one exciting electrode; and at least one collecting electrode located between at least two consecutive sets.

26. An electrostatic fluid accelerator, which comprises:

a corona discharge device including a multiplicity of closely spaced corona electrodes at least one exciting electrode shaped as a plate extending downstream with respect to a desired fluid flow direction said at least one exciting electrode asymmetrically located between said corona electrodes with respect to said desired fluid flow direction such that a desired fluid flow is generated in said desired fluid flow direction;

one or more additional corona discharge devices, each of said additional corona discharge devices being located downstream, with respect to a desired direction of fluid flow, from a preceding corona discharge device; and at least one collecting electrode located between at least one pair of said corona discharge devices.

27. An electrostatic fluid accelerator comprising:

(i) a flexible top high-voltage supply, including;

(a) a base unit that produces a base output voltage which is relatively insensitive to an output current of the power supply, (b) a second unit that is relatively sensitive to said output current of said power supply whereby an flexible output voltage of said second unit decreases in response to an increase in said output current from the power supply; and (c) combining circuitry configured to combine said base output voltage from said base unit and said flexible output voltage of said second unit into a common power supply output; and (ii) an assemblage of electrodes including a set of electrodes connected to said common power supply output for producing a corona discharge, said set of electrodes including a multiplicity of closely spaced corona electrodes and at least one exciting electrode shaped as a plate extending downstream with respect to a desired fluid flow direction, said at least one exciting electrode asymmetrically located between said corona electrodes with respect to said desired fluid flow direction such that a desired fluid flow is generated in said desired fluid flow direction.

28. The device employing electrodes as recited in claim 27, wherein:

at least one set of electrodes is located in a separate frame having an opening for free fluid passage.

29. The electrostatic fluid accelerator according to claim 27, wherein:

said base unit comprises a plurality of series connected first capacitors receiving a high frequency power signal at an input of said series connection and providing said base output voltage; and said second unit comprising a second capacitor connected to receive said high frequency power signal and to provide said flexible output voltage in series with said base voltage provided by said series connected first capacitors, said second capacitor having a capacitance less than a value of capacitance of said first capacitors.

* * * * *

US006504308C1

(12) EX PARTE REEXAMINATION CERTIFICATE (8139th)

United States Patent

Krichtafovitch et al.

(10) Number: US 6,504,308 C1

(45) Certificate Issued: Apr. 5, 2011

(54) ELECTROSTATIC FLUID ACCELERATOR

(75) Inventors: Igor A. Krichtafovitch, Bothell, WA (US); Robert L. Fuhriman, Jr., Bellevue, WA (US)

(73) Assignee: High Voltage Integrated, L.L.C., Bellevue, WA (US)

Reexamination Request:
No. 90/007,276, Oct. 29, 2004

Reexamination Certificate for:

| | |
|---|---|
| Patent No.: | **6,504,308** |
| Issued: | **Jan. 7, 2003** |
| Appl. No.: | **09/419,720** |
| Filed: | **Oct. 14, 1999** |

Related U.S. Application Data

(60) Provisional application No. 60/104,573, filed on Oct. 16, 1998.

(51) Int. Cl.
*H01J 7/24* (2006.01)

(52) U.S. Cl. ..... 315/111.91; 315/111.21; 250/423 R

(58) Field of Classification Search ..... None
See application file for complete search history.

(56) References Cited

U.S. PATENT DOCUMENTS

| | | | | |
|---|---|---|---|---|
| 1,345,790 | A | 7/1920 | Lodge | |
| 1,934,923 | A | 11/1933 | Heinrich | |
| 1,959,374 | A | 5/1934 | Lissman | |
| 2,587,173 | A | 2/1952 | Landgraf | |
| 2,590,447 | A | 3/1952 | Nord, Jr. et al. | |
| 2,765,975 | A | 10/1956 | Lindenblad | |
| 2,815,824 | A | 12/1957 | Armstrong et al. | |
| 2,826,262 | A | 3/1958 | Byerly | |
| 2,950,387 | A | 8/1960 | Brubaker | |
| 3,026,964 | A | 3/1962 | Penney | 96/74 |
| 3,071,705 | A | 1/1963 | Coleman et al. | |
| 3,198,726 | A | 8/1965 | Trikilis | |
| 3,443,358 | A | 5/1969 | Drenning et al. | |
| 3,452,225 | A | 6/1969 | Gourdine | |
| 3,740,927 | A | 6/1973 | Vincent | |

(Continued)

FOREIGN PATENT DOCUMENTS

| | | |
|---|---|---|
| JP | 60-114363 | 6/1985 |

OTHER PUBLICATIONS

Manual on Current Mode PWM Controller, LinFinity Microelectronics (SG1842/SG1843 Series, Apr. 2000).

(Continued)

*Primary Examiner*—Margaret Rubin

(57) ABSTRACT

An electrostatic fluid accelerator having a multiplicity of closely spaced corona electrodes. The close spacing of such corona electrodes is obtainable because such corona electrodes are isolated from one another with exciting electrodes. Either the exciting electrode must be placed asymmetrically between adjacent corona electrodes or an accelerating electrode must be employed. The accelerating electrode can be either an attracting or a repelling electrode. Preferably, the voltage between the corona electrodes and the exciting electrodes is maintained between the corona onset voltage and the breakdown voltage with a flexible top high-voltage power supply. Optionally, however, the voltage between the corona electrodes and the exciting electrodes can be varied, even outside the range between the corona onset voltage and the breakdown voltage, in to vary the flow of fluid. And, to achieve the greatest flow of fluid, multiple stages of the individual Electrostatic Fluid Accelerator are utilized with a collecting electrode between successive stages in order to preclude substantially all ions and other electrically charged particles from passing to the next stage, where they would tend to be repelled and thereby impair the movement of the fluid. Finally, constructing the exciting electrode in the form of a plate that extends downstream with respect to the desired direction of fluid flow also assures that more ions and, consequently, more fluid particles flow downstream.

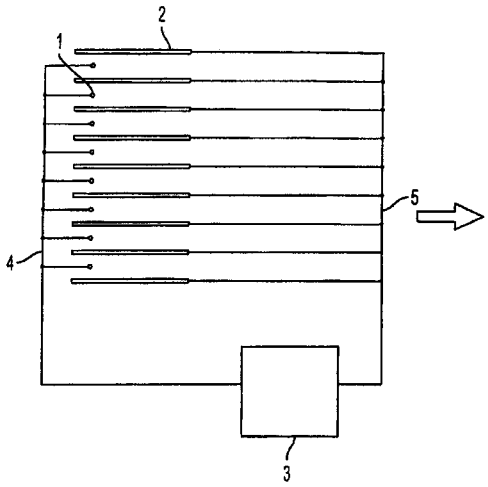

U.S. PATENT DOCUMENTS 3,892,927 A 7/1975 Lindenberg
3,907,520 A 9/1975 Huang et al.
3,918,939 A 11/1975 Hardt
3,981,695 A 9/1976 Fuchs ..... 96/77
3,984,215 A 10/1976 Zucker ..... 95/81
4,086,152 A 4/1978 Rich et al.
4,126,434 A 11/1978 Keiichi
4,156,885 A 5/1979 Baker et al.
4,194,888 A 3/1980 Schwab et al.
4,210,847 A 7/1980 Shannon et al.
4,216,000 A 8/1980 Kofoid
4,232,355 A 11/1980 Finger et al.
RE30,480 E 1/1981 Gelfand
4,259,707 A 3/1981 Penney
4,369,776 A 1/1983 Roberts
4,376,637 A 3/1983 Yang
4,380,720 A 4/1983 Fleck
4,401,385 A 8/1983 Katayama et al.
4,477,268 A 10/1984 Kalt
4,481,017 A 11/1984 Furlong
4,496,375 A 1/1985 Le Vantine
4,567,541 A 1/1986 Terai ..... 361/235
4,574,326 A 3/1986 Myochin et al.
4,587,541 A 5/1986 Dalman et al.
4,600,411 A 7/1986 Santamaria ..... 96/82
4,604,112 A 8/1986 Ciliberti et al.
4,632,135 A 12/1986 Lenting et al.
4,646,196 A 2/1987 Reale
4,649,703 A 3/1987 Dettling et al.
4,689,056 A 8/1987 Noguchi et al. ..... 96/97
4,713,724 A 12/1987 Voelkel
4,740,826 A 4/1988 Chatterjee
4,740,862 A 4/1988 Halleck
4,741,746 A 5/1988 Chao et al.
4,772,998 A 9/1988 Guenther, Jr. et al.
RE32,767 E 10/1988 Jonelis
4,775,915 A 10/1988 Walgrove, III
4,783,595 A 11/1988 Seidl
4,789,801 A 12/1988 Lee ..... 310/308
4,790,861 A 12/1988 Watai et al.
4,808,200 A 2/1989 Dallhammer et al.
4,811,159 A 3/1989 Foster, Jr.
4,838,021 A 6/1989 Beattie
4,841,425 A 6/1989 Maeba et al.
4,878,149 A 10/1989 Stiehl et al.
4,936,876 A 6/1990 Reyes
4,938,786 A 7/1990 Tonomoto
4,941,068 A 7/1990 Hofmann
5,059,219 A 10/1991 Plaks et al. ..... 96/77
5,072,746 A 12/1991 Kantor
5,076,820 A 12/1991 Gurvitz
5,077,500 A 12/1991 Török et al. ..... 315/111.91
5,087,943 A 2/1992 Creveling
5,136,461 A 8/1992 Zellweger
5,138,348 A 8/1992 Hosaka et al.
5,138,513 A 8/1992 Weinstein
5,155,524 A 10/1992 Oberhardt et al.
5,163,983 A 11/1992 Lee
5,199,257 A 4/1993 Colletta et al.
5,215,558 A 6/1993 Moon
5,257,073 A 10/1993 Gross et al.
5,269,131 A 12/1993 Brophy
5,302,190 A 4/1994 Williams
5,368,839 A 11/1994 Aime et al.
5,369,953 A 12/1994 Brophy
5,423,902 A 6/1995 Strutz et al.
5,484,472 A 1/1996 Weinberg
5,508,880 A 4/1996 Beyer
5,535,089 A 7/1996 Ford et al.
5,542,967 A 8/1996 Ponizovsky et al.
5,569,368 A 10/1996 Larsky et al.
5,601,636 A 2/1997 Glucksman
5,642,254 A 6/1997 Benwood et al.
5,656,063 A 8/1997 Hsu
5,665,147 A 9/1997 Taylor et al.
5,707,422 A 1/1998 Jacobsson et al.
5,779,769 A 7/1998 Jiang
5,847,917 A 12/1998 Suzuki
5,854,742 A 12/1998 Faulk
5,894,001 A 4/1999 Hitzler et al.
D411,001 S 6/1999 Pinchuk
5,920,474 A 7/1999 Johnson et al.
5,942,026 A 8/1999 Erlichman et al.
6,007,682 A 12/1999 Hancock et al.
D420,438 S 2/2000 Pinchuk
6,023,155 A 2/2000 Kalinsky et al.
6,039,816 A 3/2000 Morita et al.
D427,300 S 6/2000 Pinchuk
6,108,504 A 8/2000 Dickhoff
6,125,636 A 10/2000 Taylor et al.
D433,494 S 11/2000 Pinchuk et al.
D434,483 S 11/2000 Pinchuk
6,163,098 A 12/2000 Taylor et al.
D438,513 S 3/2001 Pinchuk
6,195,827 B1 3/2001 Dumitriu
D440,290 S 4/2001 Pinchuk
6,215,248 B1 4/2001 Noll
6,224,653 B1 5/2001 Shvedchikov et al.
6,228,330 B1 5/2001 Herrmann et al.
6,270,733 B1 8/2001 Rodden
6,312,507 B1 11/2001 Taylor et al.
6,350,417 B1 2/2002 Lau et al.
6,394,086 B1 5/2002 Barnes et al.
6,404,089 B1 6/2002 Tomion
6,574,123 B2 6/2003 Wiser et al.
6,603,268 B2 8/2003 Lee
6,603,795 B2 8/2003 Ma et al.
6,664,741 B1 12/2003 Krichtafovitch
6,727,657 B2 4/2004 Krichtafovitch et al.
6,888,314 B2 5/2005 Krichtafovitch et al.
6,919,698 B2 7/2005 Krichtafovitch
6,937,455 B2 8/2005 Krichtafovitch et al.
6,963,479 B2 11/2005 Krichtafovitch
2001/0004046 A1 6/2001 Taylor et al.
2001/0032544 A1 10/2001 Taylor et al.
2001/0048906 A1 12/2001 Lau et al.
2002/0079212 A1 6/2002 Taylor et al.
2002/0098131 A1 7/2002 Taylor et al.
2002/0122751 A1 9/2002 Sinalko et al.
2002/0122752 A1 9/2002 Taylor et al.
2002/0127156 A1 9/2002 Taylor
2002/0141914 A1 10/2002 Lau et al.
2002/0155041 A1 10/2002 McKinney, Jr. et al.
2003/0033176 A1 2/2003 Hancock
2003/0147785 A1 8/2003 Joannou
2003/0165410 A1 9/2003 Taylor
2003/0170150 A1 9/2003 Lau et al.
2003/0206837 A1 11/2003 Taylor et al.
2003/0206839 A1 11/2003 Taylor et al.
2003/0206840 A1 11/2003 Taylor et al.
2003/0209420 A1 11/2003 Taylor et al.
2003/0234618 A1 12/2003 Krichtafovitch
2004/0004440 A1 1/2004 Krichtafovitch et al.
2004/0004797 A1 1/2004 Krichtafovitch et al.
2004/0025497 A1 2/2004 Truce
2004/0033340 A1 2/2004 Lau et al.
2004/0047775 A1 3/2004 Lau et al.
2004/0052700 A1 3/2004 Kotlyar et al.
2004/0057882 A1 3/2004 Lau et al.

| | | | |
|---|---|---|---|
| 2004/0079233 | A1 | 4/2004 | Lau et al. |
| 2004/0211675 | A1 | 10/2004 | Dong et al. |
| 2004/0212329 | A1 | 10/2004 | Krichtafovitch et al. |
| 2004/0217720 | A1 | 11/2004 | Krichtafovitch et al. |
| 2005/0151490 | A1 | 7/2005 | Krichtafovitch |

OTHER PUBLICATIONS

Chen, Junhong, "Direct–Current Corona Enhanced Chemical Reactions", Thesis, University of Minnesota, USA. Aug. 2002, Download from http://www.menet.umn.edu/~jhchen/junhong_dissertation_final.pdf.

Humpries, Stanley, "Principles of Charged Particle Acceleration", Chapter 9, Department of Electrical and Engineering, University of New Mexico, 1999, Download from: <http://www.fieldp.com/cpa/cpa.html>.

Product Catalog of GE–Ding Information Inc. (From Website—www.reedsensor.com.tw).

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 3, 5, 7, 8, 10, 12, 14, 17 to 25 and 26-29 is confirmed.

Claims 2, 4, 6, 9, 11, 13, 15, and 16 are determined to be patentable as amended.

New claims 30-32 are added and determined to be patentable.

2. [The] *An* electrostatic fluid accelerator [as recited in claim 1,] *comprising:*

*a multiplicity of closely spaced corona electrodes; and*

*at least one exciting electrode shaped as a plate extending downstream with respect to a desired fluid flow direction, said at least one exciting electrode asymmetrically located between said corona electrodes with respect to said desired fluid flow direction such that a desired fluid flow is generated in said desired fluid flow direction,* wherein[:]

a voltage between said corona electrodes and said exciting electrodes is variable, even outside the range between the corona onset voltage and the breakdown voltage.

4. [The] *An* electrostatic fluid accelerator [as recited in claim 1,] *comprising:*

*a multiplicity of closely spaced corona electrodes; and*

*at least one exciting electrode shaped as a plate extending downstream with respect to a desired fluid flow direction, said at least one exciting electrode asymmetrically located between said corona electrodes with respect to said desired fluid flow direction such that a desired fluid flow is generated in said desired fluid flow direction,* wherein[:]

a voltage between said corona electrodes and said exciting electrodes is maintained between the corona onset voltage and the breakdown voltage.

6. [The] *An* electrostatic fluid accelerator [as recited in claim 4] ,* comprising:

*a multiplicity of closely spaced corona electrodes; and*

*at least one exciting electrode shaped as a plate extending downstream with respect to a desired fluid flow direction, said at least one exciting electrode asymmetrically located between said corona electrodes with respect to said desired fluid flow direction such that a desired fluid flow is generated in said desired fluid flow direction,* wherein:

[the] *a* voltage between said corona electrodes and said exciting electrodes *is maintained between the corona onset voltage and the breakdown voltage and* is controlled by a flexible top high-voltage power supply.

9. [The] *An* electrostatic fluid accelerator [as recited in claim 8,] *comprising:*

*a multiplicity of closely spaced corona electrodes;*

*a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and*

*at least one accelerating electrode located downstream from said corona electrodes with respect to said desired fluid flow direction,* wherein[:]

a voltage between said corona electrodes and said accelerating electrodes is maintained between the corona onset voltage and the breakdown voltage.

11. [The] *An* electrostatic fluid accelerator [as recited in claim 10] *comprising:*

*a multiplicity of closely space corona electrodes;*

*a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and*

*at least one accelerating electrode located downstream from said corona electrodes with respect to said desired fluid flow direction, wherein*

*a voltage between said corona electrodes and said accelerating electrodes is maintained between the corona onset voltage and the breakdown voltage and a voltage between said corona electrodes and said exciting electrodes is variable, even outside the range between the corona onset voltage and the breakdown voltage, and* wherein[:]

the accelerating electrode is an attracting electrode, said attracting electrode having opposite electrical polarity to that of said corona electrodes and said attracting electrode being located, with respect to the desired direction of fluid flow, downstream from said corona electrodes.

13. [The] *An* electrostatic fluid accelerator [as recited in claim 10] *comprising:*

*a multiplicity of closely spaced corona electrodes;*

*a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and*

*at least one accelerating electrode located downstream from said corona electrodes with respect to said desired fluid flow direction, wherein*

*a voltage between said corona electrodes and said accelerating electrodes is maintained between the corona onset voltage and the breakdown voltage and a voltage between said corona electrodes and said exciting electrodes is variable, even outside the range between the corona onset voltage and the breakdown voltage, and* wherein[:]

the accelerating electrode is a repelling electrode, said repelling electrode having the same electrically polarity as that of said corona electrodes and said repelling electrode being located, with respect to the desired direction of fluid flow, upstream from said corona electrodes.

15. [The] *An* electrostatic fluid accelerator [as recited in claim 8,] *comprising:*

*a multiplicity of closely spaced corona electrodes;*

*a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and*

*at least one accelerating electrode located downstream from said corona electrodes with respect to said desired fluid flow direction,* wherein[:]

a voltage between said corona electrodes and sad exciting electrodes is maintained between a corona onset voltage and a breakdown voltage.

16. [The] *An* electrostatic fluid accelerator [as recited in claim 15,] *comprising:*

*a multiplicity of closely spaced corona electrodes;*

*a least one exciting electrode plate extending downstream with respect to a desired fluid flow direction, said at least one exciting electrode asymmetrically located between said corona electrodes with respect to said desired fluid flow direction such that a desired fluid flow is generated in said desired fluid flow direction; and*

*at least one accelerating electrode located downstream from said corona electrodes with respect to said desired fluid flow direction*, wherein[:]

*a voltage between said corona electrodes and said exciting electrodes is maintained between a corona onset voltage and a breakdown voltage, and* the accelerating electrode is an attracting electrode, said attracting electrode having opposite electrical polarity to that of said corona electrodes and said attracting electrode being located, with respect to desired direction of fluid flow, downstream from said corona electrodes.

*30. The electrostatic fluid accelerator as recited in claim 1, wherein said desired fluid flow is generated in said desired fluid flow direction by an interaction of said exciting and corona electrodes.*

*31. The electrostatic fluid accelerator as recited in claim 8, wherein said desired fluid flow is generated in said desired fluid flow direction by an interaction of said exciting and corona electrodes.*

*32. The electrostatic fluid accelerator as recited in claim 26, wherein said desired fluid flow is generated in said desired fluid flow direction by an interaction of said exciting and corona electrodes.*

* * * * *